United States Patent [19]

Pagliaro et al.

[11] Patent Number: 4,846,245

[45] Date of Patent: Jul. 11, 1989

[54] FOLDING DOOR APPARATUS

[75] Inventors: James M. Pagliaro, Carlisle; Robert E. Zimmerman, Harrisburg, both of Pa.

[73] Assignee: Alto Garage Door

[21] Appl. No.: 89,760

[22] Filed: Aug. 27, 1987

[51] Int. Cl.[4] ..... E05D 15/26

[52] U.S. Cl. ..... 160/207; 160/201

[58] Field of Search ..... 160/207, 206, 201

[56] References Cited

U.S. PATENT DOCUMENTS 3,757,845 9/1973 Pagliaro ..... 160/207 X 4,303,117 12/1981 Lindbergh ..... 160/207 X

*Primary Examiner*—Blair M. Johnson

[57] ABSTRACT

Folding door apparatus includes panels which are hinged to rotate into a stacked position over head as a winding drum draws a cable attached to the lowermost panel. Alternate panels have first roller brackets carrying respective first rollers which ride in a vertical first trackway, and second brackets carrying spring loaded second rollers which ride in a second trackway angled at the top to determine folding sequence of the panels. Each first bracket has a cam surface which acts on a stop to pivot it through a respective aperture in the first trackway as the respective panel approaches the horizontal position. The first rollers are thus supported by the pivotable stops when the panels are in the horizontal position.

7 Claims, 3 Drawing Sheets

FOLDING DOOR APPARATUS

BACKGROUND OF THE INVENTION

The present invention relates to folding door apparatus having panels hinged to stack accordionlike above an opening in a building.

Door apparatus having panels hinged along adjacent horizontal edges and arranged to move from a coplanar position in which all panels are vertical, to a stacked position, in which all panels are substantially horizontal, are well known. U.S. Pat. No. 3,618,656 discloses such apparatus suitable for doors having an even number of panels, the upper most in each pair of panels having a pair of first rollers journaled in a pair of brackets on opposite ends thereof. All first rollers ride in a pair of vertical first trackways fixed to the building. In order to support the panels in the stacked position, each of the brackets has a finger-like extension which rotates into position over a respective fixed stud as the respective panel rotates into the horizontal or stacked position. In order to assure that the panels rotate into position in such a manner that the brackets engage only their assigned studs without jamming against any therebelow, the uppermost of each pair of panels also carries a pair of second rollers. Each pair of second rollers rides in its own respective pair of vertical trackways which are specially formed to effect the desired sequence of panel rotation. The panels are raised by a cable attached to the lowermost panel and extending beyond the door panels into an open area.

U.S. Pat. No. 3,757,845, incorporated herein by reference, represents an improvement over the above described patent insofar as the cables extend between the first trackways and the building, and the second rollers ride in a single pair of opposed second trackways. Each second trackway has a vertical portion which parallels the first trackway and an angled portion which diverges rectilinearly therefrom. This simpler construction is made possible in part by brackets wherein the second rollers are spring biased to move substantially parallel to the plane of the respective panel. While solving the problems of the exposed cable and multiple trackways, this apparatus requires very careful field assembly to assure that the finger-like extensions rotate smoothly into position over the studs. Tolerances in the system change with use so that adjustment is eventually required. Further, the finger-like extensions extend into the path of the cable and thus are abraded by the cable during opening and closing of the door.

SUMMARY OF THE INVENTION

The present invention is directed to a folding door apparatus having at least one pair of opposed stops which are movable from an inactive position wherein they are clear of respective first trackways, to an active position, wherein they interfere with respective first trackways sufficiently to impede passage of respective first rollers therein. Each pair of stops is activated sequentially by cam means fixed to a panel when the first rollers fixed to the panel are above the stops. The rollers fixed to upper panels can pass the stops intended for lower panels without the lower stops moving into the active position. The apparatus further includes a pair of second rollers associated with each panel carrying first rollers and riding in a pair of second trackways as in U.S. Pat. No. 3,757,845. This assures that the panels pivot toward a horizontal position only when further vertical movement of the associated first rollers is not possible. The cam means bears against follower means of the respective stop to pivot a support portion thereof into the trackey as the panel pivots into the horizontal position.

The system is more positive and trouble-free than those of the prior art and easier to adjust in the field. Changing tolerances of the system do not readily effect operation of the door, and there are no finger-like extensions to interfere with the cable.

DETAILED DESCRIPTION OF THE PREFERRED EMBODIMENT

Figure 1:
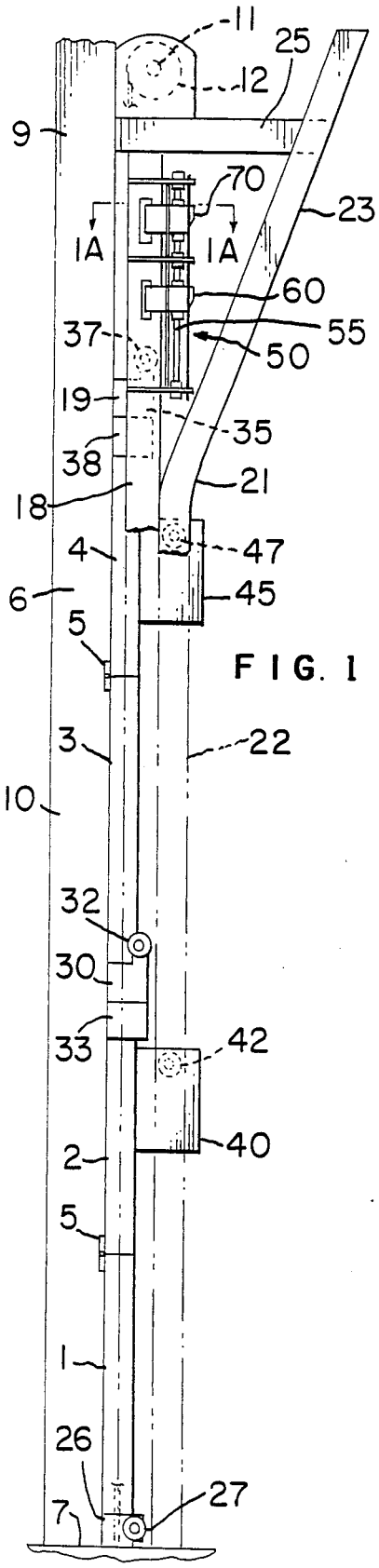
FIG. 1 is an end view of the apparatus with the door closed.

Referring to FIG. 1, the apparatus comprises four panels 1, 2, 3, 4 connected by hinges 5 and covering an opening 6 in a warehouse or the like. The opening 6 is flanked by jambs 10 extending upward from floor 7 to a lintel 9. The panels are arranged to be moved vertically by the action of a driven shaft 11 turning a drum 12 to draw a cable 14 attached to a lifting bracket (not visible) fixed to the lowermost panel 1. The arrangement of the drive means, cable, and lifting bracket is substantially as depicted in my earlier U.S. Pat. No. 3,757,845. Panel 1 has fixed to the end thereof a bracket 26 in which roller 27 is journaled by a simple axle. Panels 2 and 4 have fixed to the ends thereof respective first roller brackets 30, 35 in which first rollers 32, 37 are journaled. Rollers 27, 32 and 37 all ride in a vertical first trackway 18 fixed to jamb 10. The panels 2 and 4 also have second roller brackets 40, 45 fixed to their respective ends. The brackets 40, 45 carry respective second rollers 42, 47 in spring biased fashion as disclosed in U.S. Pat. No. 3,757,845. The rollers 42, 47 ride in a second trackway 21 which is fixed relative to jamb 10. The second trackway 21 includes a vertical lower portion 22, which parallels the first trackway 18, and an upper portion 23 which diverges therefrom. A bracket 25 is fixed between the upper end of portion 23 and the lintel 10. The rollers 42, 47 are situated in the lower portion 22 when the panels are coplanar as shown.

Note that while only one end or vertical side of the doorway or opening 6 is shown in the Figures, the apparatus on the opposite end is substantially the mirror image. While only one end of the doorway is shown and described, it will be understood that similar structure and operation appears on the other end. A rear elevation of a similar door, albeit with five panels, is depicted in U.S. Pat. No. 3,757,845.

Referring again to FIG. 1, the apparatus further includes a stop assembly 50 which is likewise fixed to jamb 10. This assembly includes stops 60, 70 which pivot about shaft 55 to support respective rollers 32, 37 when the panels are in the stacked position.

Figure 1A:
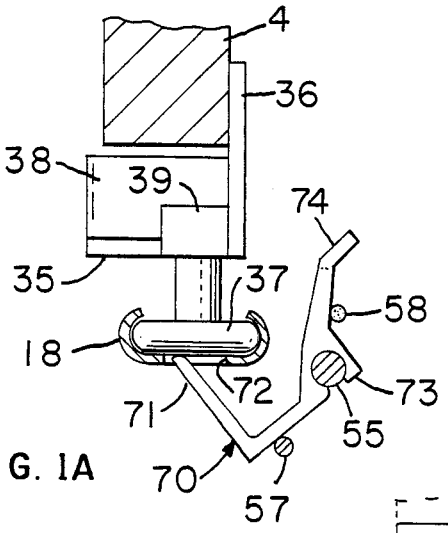
FIG. 1A is a partial plan view, taken along line 1A—1A of FIG. 1.

Referring to FIG. 1A, the upper stop 70 includes an L-shaped roller support 71 poised just outside of aperture 72 in the first trackway 18, where the uppermost first roller 37 is visible. The stop 70 has a bearing portion 73 journaled on shaft 55 and a cam follower 74 opposite the support 71. The stop is held in this position by a spring loaded cable 58 which causes it to bear against limiting rod 57.

Figure 6:
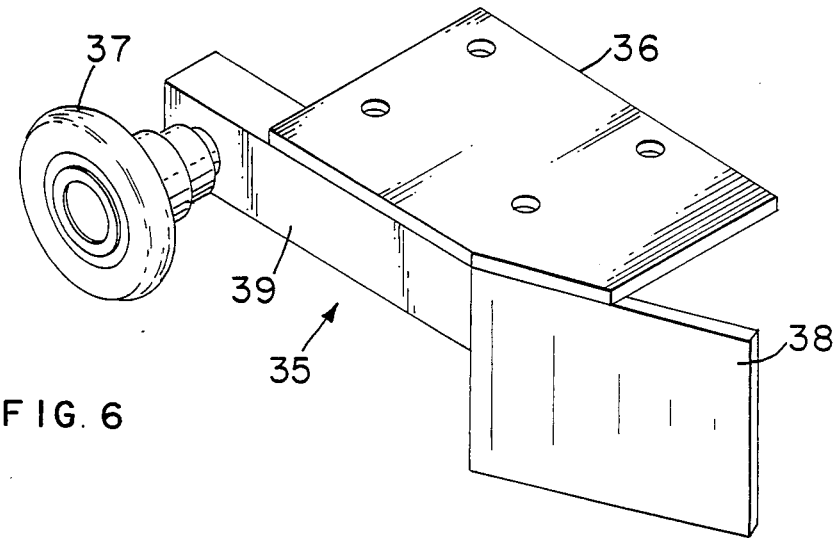
FIG. 6 is a perspective of a first roller bracket with roller and cam.

Referring also to FIG. 6, the upper first roller bracket 35 includes a mounting flange 36 for fixing to the rear surface of the panel 4 and a cam 38 formed integrally therewith. Significantly, the surface of cam 38 is angled toward the panel, being closest remote from the roller 37. The bracket 35 is formed from steel plate with a steel block 39 added for journaling the roller 37. The lower bracket 30 is of identical construction.

Figure 2:
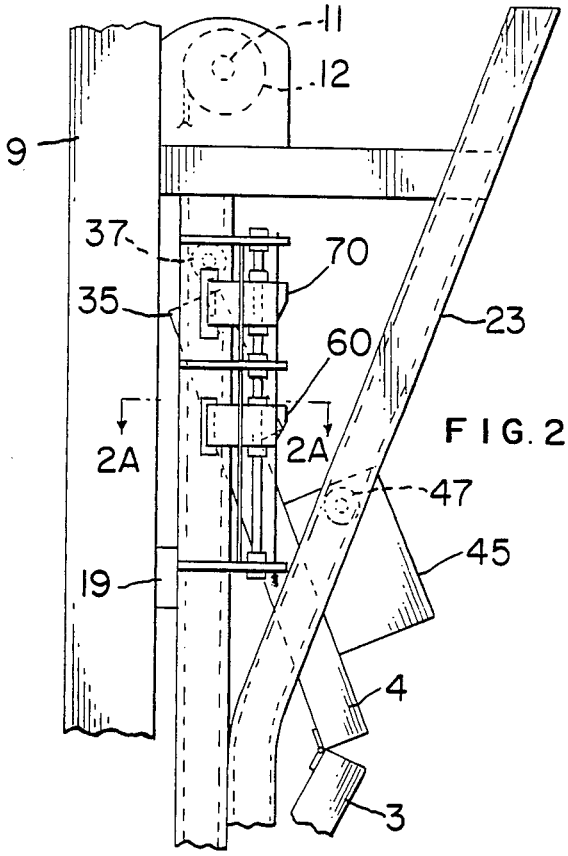
FIG. 2 is a partial end view as the top panels commence folding.
Figure 2A:
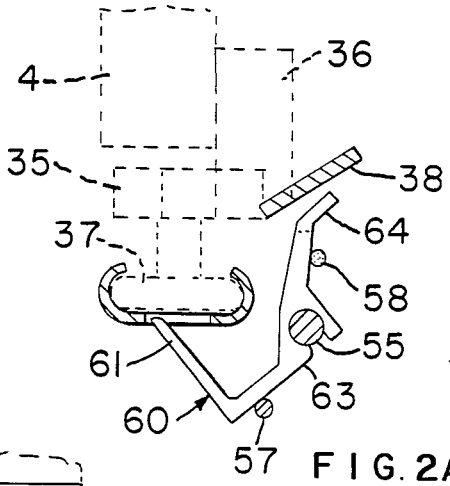
FIG. 2A is a partial plan view taken along line 2A—2A of FIG. 2.

FIG. 2 shows the apparatus as the panels are lifted by the rotation of driven shaft 11. The upper first roller 37 has moved above the stop 70 and the upper second roller 47 has entered the angled portion 23 of second trackway 21, causing the panels 3, 4 to rotate as shown. FIG. 2A depicts the lower stop 60, which includes an L-shaped roller support 61 poised outside aperture 62 in trackway 18, a bearing portion 63 journaled on shaft 55, and a cam follower 64. The sectional plane is taken through the upper bracket 35, with the portion thereabove including roller 37 shown in phantom. Note that lower first roller bracket 30 and roller 32 would appear in solid lines below the sectional plane, but have been deleted for clarity. The cam 38 is just swinging into view as the panel 4 rotates, but at this stage of rotation has not swung sufficiently far to interfere with cam follower 64. As a result the L-shaped roller support 61 does not enter the adjacent aperture 62 in first trackway 18, and the lower first roller 32 will pass freely as will be shown.

Figure 3:
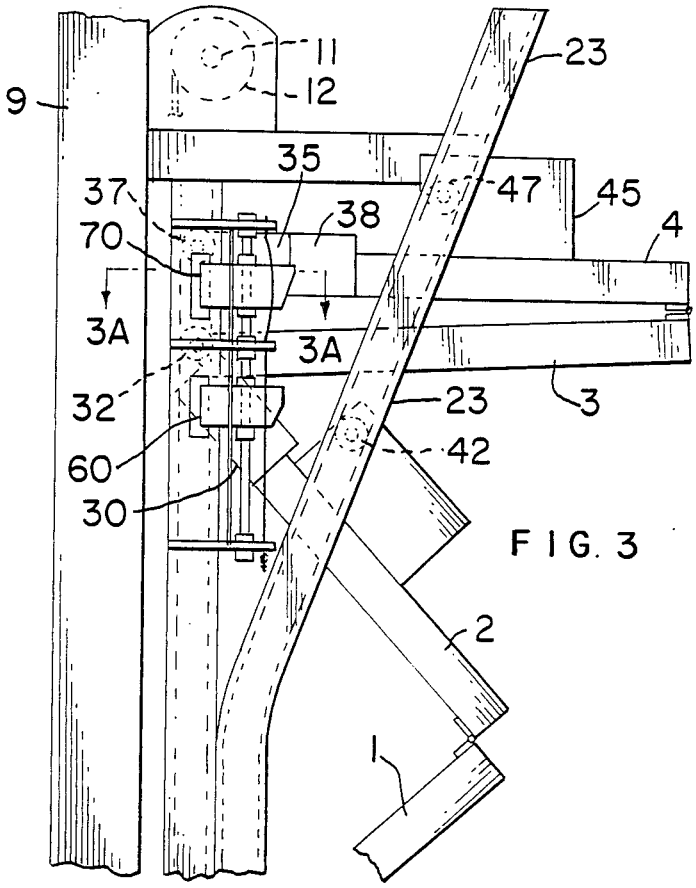
FIG. 3 is a partial end view as the bottom panels approach the stacked position.
Figure 3A:
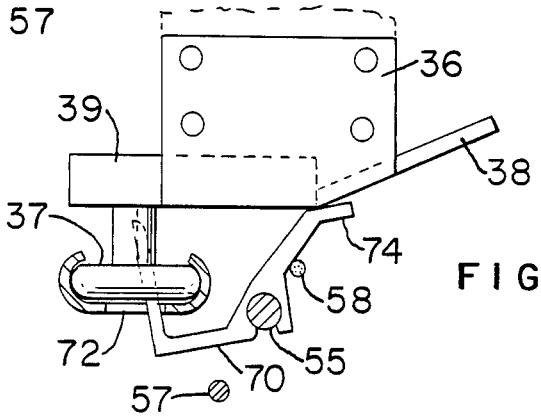
FIG. 3A is a partial plan view taken along line 3A—3A of FIG. 3.

FIG. 3 shows the apparatus as the panels 3 and 4 have reached the stacked position, where they are substantially horizontal. At this point the upper first roller bracket 35 has rotated through about 90 degrees, causing its cam 38 to bear against follower 74 on pivotal stop 70 as shown in FIG. 3A. This causes the stop 70 to pivot about shaft 55 so that L-shaped support 71 swings into aperture 72 of the first trackway, where it can support the roller 37. An important feature of the invention is that the roller 37 does not come to rest on the stop until the panel 4 is in the horizontal position. Meanwhile, the lower second roller 42 has entered the angled portion 23 of second trackway 21, causing the panels 1, 2 to rotate as shown. The lower first roller 32 is above the stop 60, and the lower first roller bracket 30 is beginning to rotate past the lower stop 60, so that the cam 33 will bear on the follower 64 to cause the L-shaped support 61 to enter aperture 62 (see FIG. 5).

Figure 5:
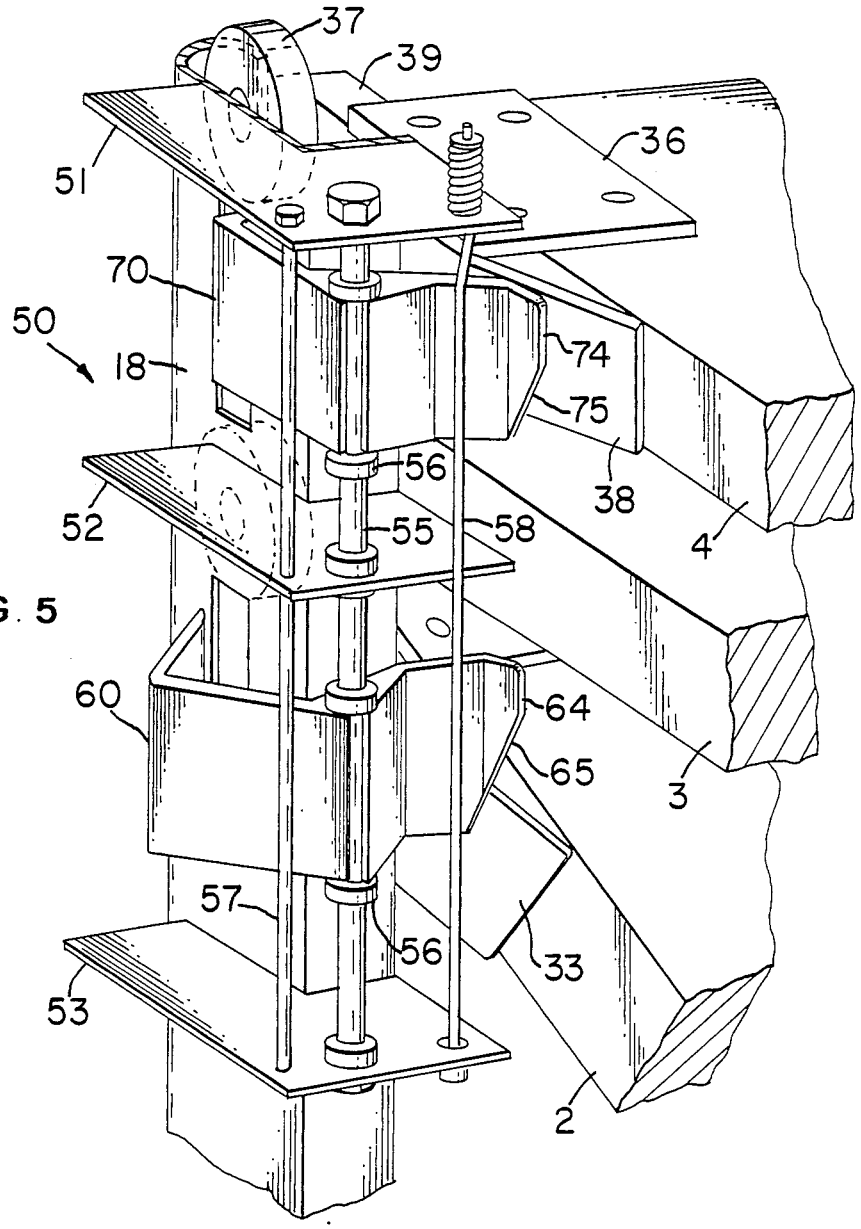
FIG. 5 is a perspective the stop assembly associated with one trackway.

FIG. 5 depicts the stop assembly 50 at the stage corresponding to FIG. 3, before the stop 60 has been pivoted. The assembly 50 comprises three horizontal plates 51, 52, 53 fixed to first trackway 50. The pivot shaft 55 is simply a long bolt with collars 56 fixed thereto to axially locate stops 60 and 70. A cable spring 58 serves to load the stops toward the inactive position, occupied in this view by lower stop 70. A limiting rod 57 limits rotation. The stops 60, 70 are substantially identical, being most conveniently manufactured from an aluminum extrusion. The cam followers 64, 74 have bevelled surfaces 65, 75 which facilitate engagement of respective cams 33, 38. These surfaces are sawn or ground, and serve as the only distinction from stops on the other side of the doorway.

Figure 4:
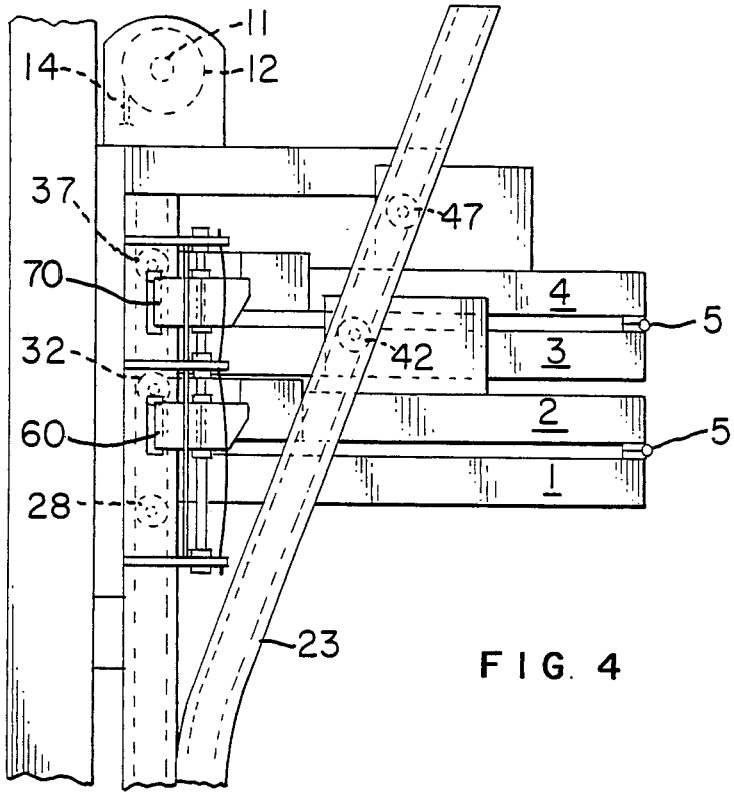
FIG. 4 is a partial end view showing the panels in the stacked position.

FIG. 4 is an end view of the assembly with all of the panels 1, 2, 3, 4 in the substantially horizontal or stacked position. The roller 32 has come to rest on stop 60, so that stops 60, 70 bear most of the weight of the panels (recall that similar rollers and stops are provided on the opposite jamb). The only weight borne by the cable 14 is thus considerably less, being only a fraction of the weight of a panel. The stress on the mechanism for raising the door is thus vastly reduced when the panels are held in the open position. When the holding tension on the cable 14 is released, panels 1 and 2 will rotate apart, roller 42 will descend in track portion 23, and the roller 32 will pivot off of the stop 60 before it pivots into the inactive position, allowing the roller 32 to descend. When the panels 1 and 2 are nearly coplanar, the panels 3 and 4 will rotate in similar fashion as the roller 47 descends and the roller 37 pivots off of the stop 70 before it pivots to the inactive position to permit the descent of roller 37. The panels 3 and 4 continue to rotate until all panels are coplanar, at which time they are lowered as a unit to the floor.

It will be apparent that the principles of the invention can also be applied to a folding door assembly having an odd number of panels, by maintaining the upper most panel in a vertical plane as in U.S. Pat. No. 3,757,845.

The foregoing is exemplary and not intended to limit the scope of the claims which follow.

We claim:

1. Folding door apparatus for mounting to a building structure adjacent a rectangular opening therein, said apparatus comprising:

a pair of first trackways for fixing to said structure adjacent opposite lateral sides of said opening, a plurality of panels hinged along adjacent horizontal edges thereof, said panels being arranged to move vertically from a coplanar position, wherein said opening is covered, to a stacked position, wherein said panels are folded accordionlike into substantially horizontal positions above said openings, at least one of said panels carrying a pair of opposed first rollers situated in respective first trackways, means for raising said panels to the stacked position, at least one pair of opposed stops for supporting said panels in the stacked position, each pair of stops being movable from an inactive position, wherein they are clear of respective first trackways, to an active position, wherein they interfere with first trackways sufficiently to impede passage of respective first rollers therein, means for activating each pair of said stops when a respective pair of rollers is thereabove, said means being responsive to one of said panels arriving at the stacked position so that each said pair of opposed stops moves to the active position in response to one of said panels arriving at the stacked position, but only when the panel which carries said respective pair of rollers is substantially in said stacked position.

2. Folding door apparatus as in claim 1 comprising at least two said pairs of opposed stops and an upper-most pair of first rollers, said means for activating said stops sequentially activating said stops commencing with the uppermost pair, whereby the uppermost pair of first rollers may pass the lower stops without being impeded thereby.

3. Folding door apparatus as in claim 1 wherein said apparatus further comprises a pair of second trackways for fixing to said structure adjacent respective said inner trackways but more remote from said structure, each of said second trackways having a vertical portion substantially parallel to a respective said first trackway and an angled portion which diverges therefrom, at least some of said panels carrying a pair of opposed second rollers situated in respective second trackways, said trackways being arranged so that two uppermost panels begin to fold accordionlike into stacked position before the panels therebelow.

4. Folding door apparatus as in claim 1 wherein said stops are pivotable from said inactive position to said active position, each of said stops having a support portion and cam follower means, said support portions being in respective trackways when the respective stops are in the active position, at least one of said panels having fixed thereto cam means which bear on respective follower means to pivot the respective support portions into the trackway as each of said at least one of said panels arrives at the stacked position.

5. Folding door apparatus as in claim 4 wherein the geometry of the cam follower means associated with each of the stops on the trackways is substantially identical, the geometry of the associated cam means likewise being identical.

6. Folding door apparatus as in claim 5 wherein the profile of the stops associated with both first trackways is identical.

7. Folding door apparatus as in claim 1 wherein during the initial stage of vertical movement said panels are arranged to move vertically as a unit while remaining coplanar.

* * * * *